US006997817B1

(12) United States Patent
Consiglio

(10) Patent No.: US 6,997,817 B1
(45) Date of Patent: Feb. 14, 2006

(54) PUTTER ALIGNMENT TOOL FOR USE IN ESTABLISHING A CORRECT LINE OF PUTTING MOTION

(76) Inventor: Joseph Consiglio, 105 Saw Timber Dr., Hilton Head Island, SC (US) 29926

( * ) Notice: Subject to any disclaimer, the term of this patent is extended or adjusted under 35 U.S.C. 154(b) by 0 days.

(21) Appl. No.: 10/984,339

(22) Filed: Nov. 9, 2004

(51) Int. Cl.
*A63B 69/36* (2006.01)

(52) U.S. Cl. ..... 473/265; 473/219; 473/257; 473/264; 473/162

(58) Field of Classification Search ..... 473/219, 473/257, 261, 262, 263, 264, 265, 158, 162
See application file for complete search history.

(56) References Cited

U.S. PATENT DOCUMENTS

| | | | | |
|---|---|---|---|---|
| 2,801,857 | A * | 8/1957 | Strunk | 473/265 |
| 3,831,949 | A * | 8/1974 | Henning | 473/158 |
| 4,230,319 | A | 10/1980 | Lindner | |
| 4,437,669 | A | 3/1984 | Pelz | |
| 4,465,281 | A * | 8/1984 | Whitfield | 473/265 |
| 4,544,160 | A * | 10/1985 | Miner | 473/218 |
| 4,732,390 | A * | 3/1988 | McCollum | 473/264 |
| 5,007,646 | A | 4/1991 | Baber et al. | |
| 5,150,904 | A | 9/1992 | Sindelar | |
| 5,797,804 | A | 8/1998 | Chen | |
| 5,882,267 | A | 3/1999 | Roe | |
| 5,919,096 | A | 7/1999 | Kim | |
| 6,019,685 | A * | 2/2000 | Fonseca et al. | 473/265 |
| 6,048,273 | A | 4/2000 | Clement | |
| 6,129,639 | A | 10/2000 | Brock et al. | |
| 6,159,106 | A | 12/2000 | Adams | |
| 6,443,852 | B1 * | 9/2002 | Kim | 473/265 |
| 6,458,039 | B1 | 10/2002 | Fontes | |
| 6,461,246 | B1 | 10/2002 | Lee et al. | |
| 6,540,620 | B1 | 4/2003 | Consiglio | |
| 6,572,486 | B2 | 6/2003 | Sweinhart | |
| 6,669,574 | B1 | 12/2003 | Riley et al. | |
| 6,679,783 | B1 | 1/2004 | Lin | |
| 6,786,833 | B2 * | 9/2004 | Ahrend | 473/265 |
| 6,840,870 | B1 * | 1/2005 | Froggatte | 473/265 |
| 2002/0022530 | A1 | 2/2002 | Yoon | |
| 2004/0009825 | A1 | 1/2004 | Hale | |

* cited by examiner

*Primary Examiner*—Nini F. Legesse
(74) *Attorney, Agent, or Firm*—Gifford, Krass, Groh, Sprinkle, Anderson & Citkowski, P.C.

(57) ABSTRACT

A putter alignment tool for use in establishing a correct line of putting motion of a golf club head upon a golf ball. An elongated structure includes a first guide wall and a second spaced apart and substantially parallel extending guide wall, the first and second guide walls being secured together proximate at least one of first and second ends. A golf ball placement position is located between the guide walls at an intermediate location between its ends. First and second adjustment mechanisms are associated with at least one of the first and second guide walls. The putter head swing clearance adjustment mechanisms include inwardly projecting portions relative to the guide walls and in order to adjust a width and height (swing window) within the structure proximate the ball placement position, the mechanisms permitting unimpeded travel of the golf club head during a putting stroke.

17 Claims, 4 Drawing Sheets

PUTTER ALIGNMENT TOOL FOR USE IN ESTABLISHING A CORRECT LINE OF PUTTING MOTION

BACKGROUND OF THE INVENTION

1. Field of the Invention

The present invention relates generally to golf assist and training devices and, more particularly, to a putter training device which incorporates an elongated structure with first and second spaced apart guide walls and first and second opposite ends. The invention is further specifically directed to the provision of one or more pairs of inwardly adjustable cam surfaces which define a minimum required lateral clearance for permitting traversing arc motion of a putter during the desired putting stroke. A height adjustable guide extends inwardly from a position either above or off to the side of the forward adjustable cam and functions to assist in gauging the alignment of the putter head during the desired putting stroke.

2. Description of the Prior Art

The present invention is well documented with many types and varieties of golf putting and training devices. In many instances, the goal of such devices is to improve, through repetition, the ability of a user to strike a golf ball in a desired direction and/or fashion and over a specified distance.

U.S. Pat. No. 6,540,620, issued to Consiglio, teaches a golf putter training device for judging a speed of impact of a golf club head upon a golf ball and including an elongated structure with a first guide wall and a second spaced apart and parallel extending guide wall. A golf ball placement position is located at a first interconnecting end of the spaced apart guide walls. An adjustable and crosswise extending passageway with pivoting flaps is located proximate a second interconnecting end and determines a selected width for allowing passage therethrough of a golf ball which is struck at said placement portion and travels along the elongated structure between the first and second guide walls.

A sensor circuit includes first and second pairs of spaced apart sensors mounted in opposing fashion and at spaced apart locations to the first and second guide walls. A counter assembly including a logic circuit interfaces with the sensor circuit to signal start and stop positions of the sensor circuit dependent upon first and second travel positions of the golf ball. A digital to analog converter is communicable with the logic circuit and converts an incremented output from the sensors for subsequent presentation on a display circuit. A power supply communicates with the sensor circuit, counter assembly, digital to analog converter and display circuit for supplying an electrical power input.

Riley, U.S. Pat. No. 6,669,574, teaches a golf training device including a level passageway defined between a pair of elevated and spaced apart side walls. At least one of the walls is inwardly adjustable to provide for a narrow and straight pathway for the putter head. The device, as thus adjusted, guides the golfer in swinging the putter head along a straight line and hitting the ball along a desired path. Vertically spaced electrodes running the length of the respective guide member inner walls sound a buzzer when the head of the putter makes contact with the guide member wall. Lengthwise reference lines are provided along the guide path. Crosswise lines are located on the tops of the guide members.

Kim, U.S. Pat. No. 6,443,852, teaches a rectangular frame placeable upon an open ground location and which includes a flexible, crosswise extending and lengthwise adjustable rod. An adjustable backstop is located at a spaced location from the flexible rod and, between the two, define a desired putting stroke for a user during practice putts. A golf ball is placed upon the ground roughly in the center of the frame and the putter is drawn back a given distance to the edge of an adjustable backstop. At the end of the stroke the putter just contacts a flexible rod whose position along the frame can be adjusted. The frame includes both fixed and adjustable markings to allow the golfer to judge the beginning of the putting stroke and the follow through.

Baber, U.S. Pat. No. 5,007,646, teaches a golf putting practice device with an elongated base having a generally planar putter guide surface. A sight is positionable in one of a plurality of grooves located above the guide surface and includes a looped end usable to allow a golfer to ascertain whether or not he has held his head steady during a putting stroke.

Chen, U.S. Pat. No. 5,797,804, teaches a golf putting alignment trainer including a pair of spaced bodies defining inter-opposing and hollow casings defining compartments therein. Each casing is further defined by an upper wall and rear wall, each of the hollow casings having a side opening which faces each other. A movable member is mounted in the compartment of the hollow casing and a vertical adjustment device for mounting the movable member to the hollow casing and for affecting adjustment of a relative vertical position between the movable member and the hollow casing and for affecting adjustment of a relative horizontal position between the movable member and the hollow casing. A scale is attached to the movable member and adjustable in a horizontal position relative to the movable member.

Finally, U.S. Pat. No. 5,882,267, issued to Roe, teaches a golf putting trainer including a first elongated member, a second elongated member positioned generally planar and spaced apart relative to the first elongated member. A connecting member is positioned between the first and second elongated members and near a first end of the first elongated member, as well as being connected to the second elongated member near a first end of the second member. A target is slidably mounted to the connecting member and is in a slidable relationship with the connecting member, wherein the target is positioned between the first elongated member and the second elongated member.

SUMMARY OF THE PRESENT INVENTION

The present invention discloses a putter alignment tool for use in establishing a correct line of positioning of a golf club head upon a golf ball. In particular, and as previously described, the invention is further specifically directed to the provision of one or more pairs of inwardly adjustable cam surfaces which define a minimum required lateral clearance for permitting traversing arc or straight line motion of a putter during the desired putting stroke. A height adjustable guide extends inwardly from a position either above or off to the side of the forward adjustable cam in proximity to the putter head ball contact point and functions to assist in gauging the alignment of the putter during the desired putting stroke.

The device includes an elongated structure having a first guide wall and a second spaced apart and substantially parallel extending guide wall. The guide walls are secured at first and second interconnecting ends, the first end generally being defined by a golf ball placement position.

A first mechanism includes at least one pair, and preferably two spaced apart pairs, of inwardly adjustable tension cam surfaces mounted relative to opposing and inner facing surfaces of the first and second guide walls. The first mechanism includes opposingly facing and inwardly/outwardly adjustable three-dimensional cam elements exhibiting inwardly projecting cam surfaces for adjusting a width within the structure proximate to the ball placement position as it relates to the desired contact surface (sweet spot) of the putter head.

The second mechanism further includes a rotatable and elongated element mounted relative to an inner facing surface of at least one of the first and second guide walls and at a location proximate a selected one of the inwardly adjustable tension cam surfaces. The second mechanism preferably includes a height adjustable coil spring or flexible rod, arrayed proximate the ball placement position. This second mechanism includes a storage slot for the adjustable coil spring/flexible rod to be used when this teaching feature is not used.

In use, the first and second mechanisms permit unimpeded travel of the golf club head during a putting stroke. The construction of the inwardly adjustable cam elements is such that, upon being contacted by the golf club head, they will be depressed outwardly to indicate deviation of the club (putter) head from a desired path of travel. Thereafter the cam will automatically reset to its home position. The construction of the spring/flex rod is further such that, upon being contacted by the club head, the spring/flex rod will vibrate, thus indicating to the user that the putter has been lifted out of the desired swing arc.

BRIEF DESCRIPTION OF THE DRAWINGS

Reference will now be made to the attached drawings, when read in combination with the following detailed description, wherein like reference numerals refer to like parts throughout the several views, and in which:

FIG. 5A is a sectional illustration of a flexible rod utilized in substitution to the coil spring of FIG. 5.

DETAILED DESCRIPTION OF THE PREFERRED EMBODIMENTS

Figure 1:
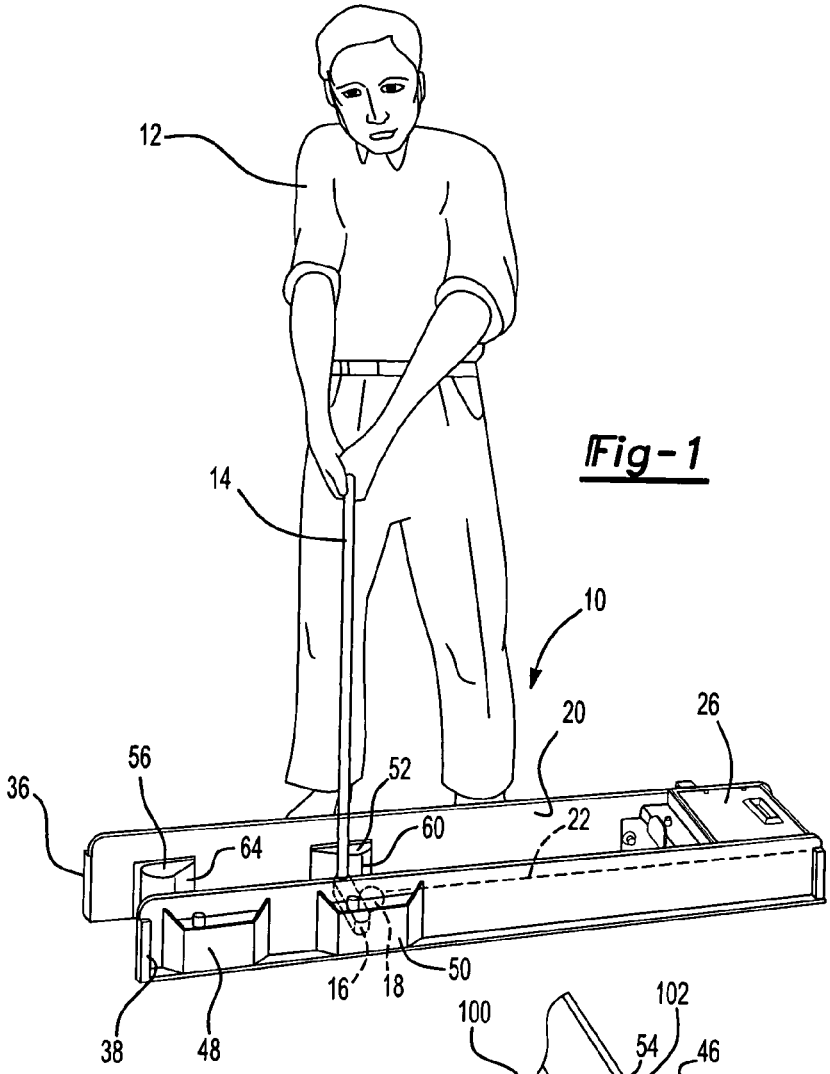
FIG. 1 is an environmental view, in perspective, of the putter alignment tool and training device according to a preferred embodiment of the present invention.

Referring now to FIG. 1, an environmental view is illustrated at 10 of a putter alignment tool and training device which is employed by a user 12 holding a golf putter 14 with a putter head 16. As previously stated, the device 10 is employed for establishing a correct line of putting motion of the golf club head 16 upon a golf ball 18.

The putter training device 10 includes an elongated structure with a first generally upwardly extending guide wall 20 and a second spaced apart, substantially parallel, and generally upwardly extending guide wall 22. The first and second guide walls 20 and 22 are preferably secured at first and second interconnecting ends. The first interconnecting end is generally illustrated, without limitation, by a flattened, plate-shaped, member 24 which is secured to the guide walls 20 and 22, respectively, by bolts 30 and 32.

The second interconnecting end is referenced by a crosswise extending and adjustable ball travel mechanism 26 which is intended to establish a passageway width for allowing passage therethrough of the golf ball 18 traveling along the elongated structure and between the first 20 and second 22 guide walls. Further description of the extending and adjustable mechanism is made with reference to the disclosure set forth in U.S. Pat. No. 6,540,620, issued to Consiglio, the contents of which are hereby incorporated by reference. It is further understood and contemplated that the putter alignment tool according to the present invention is capable of being utilized either with or without the ball travel mechanism 26 and that it is also envisioned that other structures may be substituted for that shown at 26 within the scope of the invention.

Figure 2:
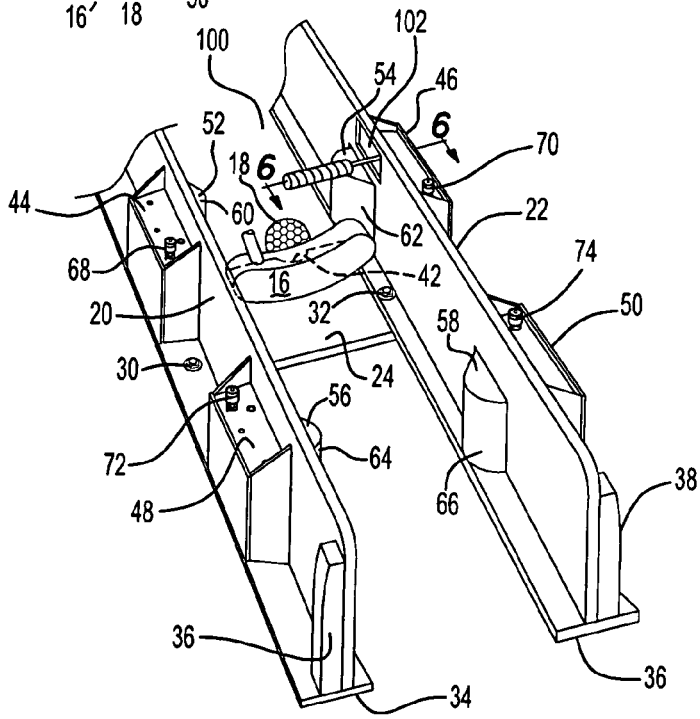
FIG. 2 is a rotated perspective and sectional end view of the putter alignment tool and training device and illustrating the first and second pairs of spaced apart and inwardly projecting, width adjustable, cam elements, combined with the inwardly extending and elongated height adjustable spring/flexible rod element.

As best illustrated in the rotated perspective view of FIG. 2, the bottom surface of the first guide wall 20 is defined by a first perpendicular ledge 34 and the corresponding bottom surface of the second guide wall 22 is defined by a second perpendicular ledge 36 and such that the ledges provide supporting surfaces for being engaged by the pluralities of bolts 30 and 32. Vertical supports 36 and 38 are provided, respectively, on both sides of the device to secure the guide walls 20 and 22 in upwardly extending fashion to the ledges 34 and 36. It is again understood that any suitable structure can be employed for securing together the guide walls 20 and 22.

Referring again to FIGS. 2 and 4, the flattened, plate-shaped member 24 includes a notch 42 for assisting in locating the ball 18. The guide walls 20 and 22 in one preferred construction are made of wood, however it is also contemplated that the elongated unit, including the guide walls and the first and second interconnecting ends (including the plate-shaped member 24) can be manufactured of a durable and high-strength polymer material such as in an injection molding process or other suitable forming process. Although further not shown, it is understood that a ball dispensing magazine or the like can be incorporated into a selected guide wall 20 or 22 of the elongated structure and in a fashion illustrated in the Consiglio reference, U.S. Pat. No. 6,540,620.

A first mechanism is provided for establishing a desired width at one or more axial locations along the structure 10 and includes one or more pairs of three-dimensional and inwardly adjustable cam assemblies. In the preferred embodiment illustrated, a first forward pair of cam assemblies are provided at 44 and 46 and which are complemented by a second and rearwardly disposed pair of cam assemblies 48 and 50. Each of the assemblies 44, 46, 48 and 50 is provided with a housing secured to an outer facing surface associated with a selected one of the guide walls, and as is referenced by spaced apart assemblies 44 and 48 secured to first guide wall 20 and opposing facing, aligning and spaced apart assemblies 46 and 50 secured to second guide wall 22.

A three-dimensional cam element incorporating an inwardly facing and contoured cam surface seats within each of the individual housings and is communicable with the axially extending interior of the structure through apertures formed in the associated guide walls 20 and 22. In particular, and referencing FIGS. 2, 3 and 4, each of the individual assemblies includes a pivotally disposed and three-dimensional cam element secured within the associated housing and inwardly projecting through an aperture formed in the associated guide wall.

In particular, cam elements 52, 54, 56 and 58 are provided for individual assemblies 44, 46, 48 and 50, respectively. Each of the cam elements presents in particular an arcuate and inwardly/outwardly adjustable cam surface and such is further referenced by surfaces 60, 62, 64 and 66 associated with cam elements 52, 54, 56 and 58, respectively, which project through apertures (typically rectangular shaped) and which are formed in corresponding side wall locations of the guide walls 20 and 22.

An adjustment knob extends from a top surface of each housing see at 68, 70, 72 and 74, respectively for housing assemblies 44, 46, 48 and 50 and is operable to manipulate, to any individual adjustments, the inwardly extending position of each cam surface relative to its associated guide wall. As is best illustrated by the overhead view of FIG. 3 and FIG. 4, stem portion is associated with each of the cam elements and secures about a pivot point extending vertically within the housing.

Specifically, stem portions 76, 78, 80 and 82 each form a part of and extend from associated cam elements 60, 62, 64 and 66, respectively, and correspond to pivot points 84, 86, 88 and 90. Rotatable surfaces associated with each of the adjustment knobs 68, 70, 72 and 74 contact respective stem portions 76, 78, 80 and 82 and are operable to manipulate the cam elements to any desired opening within their full open and full closed position to associated projecting cam surfaces in the manner illustrated by positions 52' and 52" for cam element 52, at 54' and 54" for cam element 54, at 56' and 56" for cam element 56 and, finally, at 58' and 58" for cam element 58.

Figure 3:
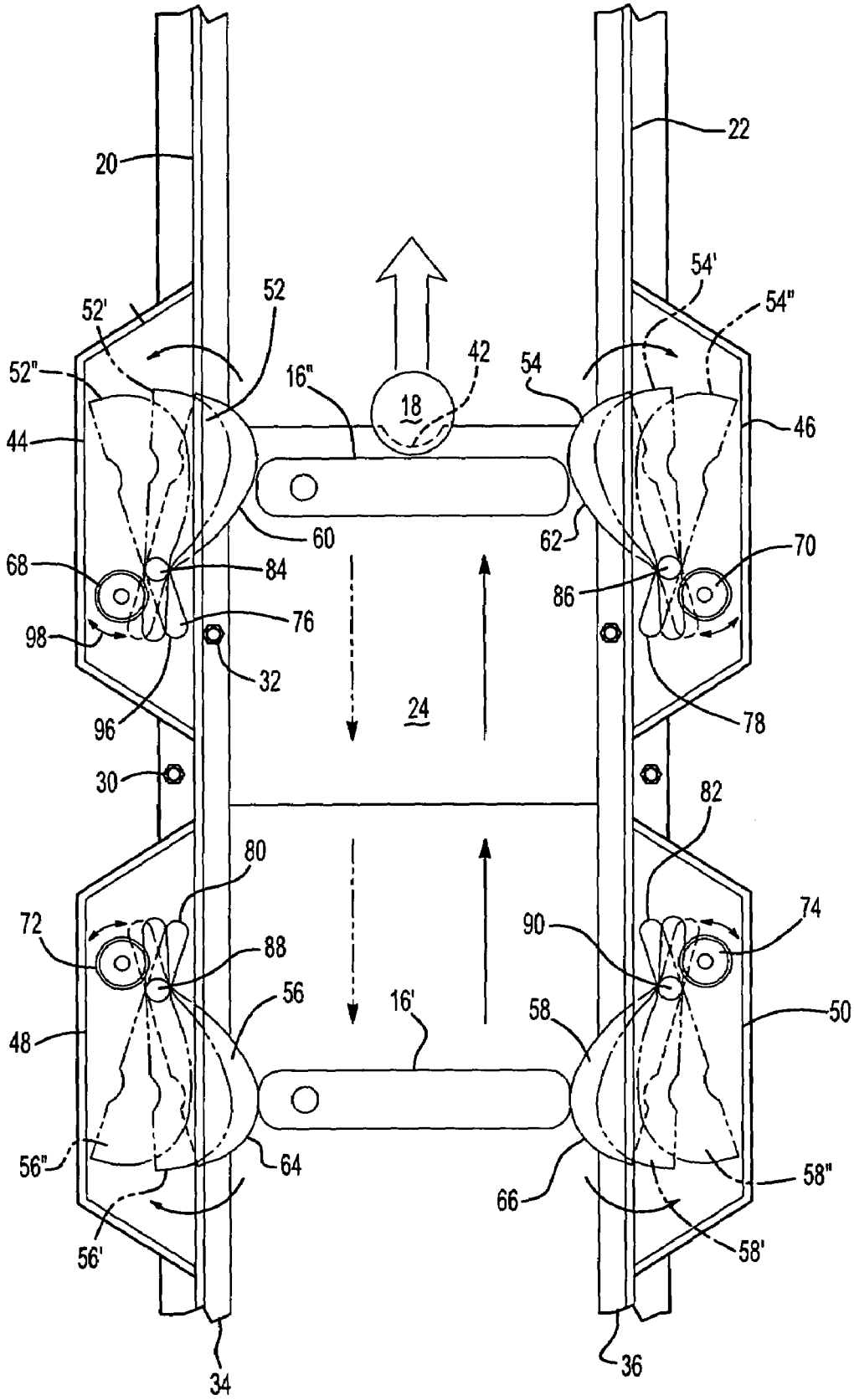
FIG. 3 is an overhead sectional view of the putter training device and illustrating the arrangement of the first and second pairs of inwardly/outwardly projecting cam elements.
Figure 4:
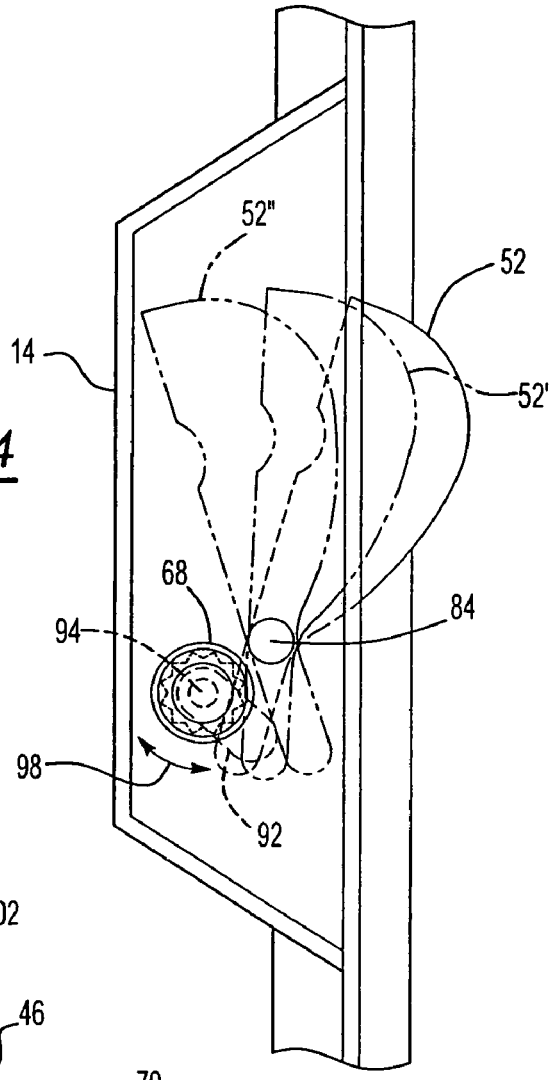
FIG. 4 is an enlarged and cutaway sectional view of a selected cam element according to the present invention.

In a preferred application, and referring to cam assembly 44 in FIGS. 3 and 4, a linkage 92 is pivotally secured at a first location 94 to a centerline extending body portion associated with the adjustment knob 68 in FIG. 3 and understood to extend downwardly from the knob 68 to an interior location of the housing. The linkage 92 secures at an opposite end 96, in likewise pivotal fashion, to a location of the stem 76 and, by virtue of the bi-directional rotational actuation of the knob 68, see arrow 98, actuates the cam element to any setting between positions 52, 52' and 52". It is further understood that each cam linkage mechanism is under aconstant inward direction spring tension that is positioned adjustable (Cam 52) by the adjustment knob 68. The adjustment knob is further understood to be rotated to move the cam 52 to a flush position with corresponding sidewalls of guide wall 20 & 22 when its desired not to utilize this teach in combination to other cams. Each of the other repositionable cam assemblies 46, 48 and 50 include identical structure to that described above in reference to assembly 44, such that a repetitive description is not necessary.

It is also understood and envisioned that any number of different structures may be employed for pivotally repositioning the inwardly projecting cam elements in order to define a desired and minimum width passageway for maintaining a straight and even putter head 16 travel. Referring again to FIG. 3, an initial position of the putter head 16 precedes a backstroke position 16' (coinciding with the location of the rearward or second pair 48 and 50 of cam assemblies) which is followed by a forward follow through position 16" in which the putter head is positioned in alignment with the initial pair 44 and 46 of cam assemblies.

In one preferred embodiment, only one pair (typically the forward pair 44 and 46) of the cam assemblies is required and which may be positioned either behind, in front of, or even with the ball 18 placement location. In the preferred embodiment illustrated, the second pair of cam assemblies 48 and 50 is located a predetermined spaced distance (typically 3"–12") rearwardly (in a backstroke direction) from the forward pair 44 and 46 of cam assemblies and in order to maintain a correct putter head alignment during the backstroke motion.

In combination with the above disclosure, a further mechanism is provided for defining a maximum height for permitting unimpeded travel of the golf club head 16 and ball 18 during the putting stroke. In particular, and referencing FIGS. 5 and 6, a rotatable and elongated element 100 is mounted relative to an inner facing surface of at least one of the first and second guide walls. In the preferred embodiment illustrated, an elongated coil spring 100 is secured in proximity to an inner facing surface of the second guide wall 22, and such as is vertically adjustable along a window 102 defined in the guide wall 22.

The dimensions of the wall aperture 102 are typically such that the coil element 100 is capable of being rotated between recessed and extended positions relative to the interior passageway defined along the structure. In order to provide a degree of height adjustability to the spring/flexible rod 100, a vertically extending spring 104 is secured to a collar 106 defining a mounting end of the rotatable and elongated spring/flexible rod 100. The spring 104 extends within a vertically disposed shaft portion which includes exteriorly positioned and spiraling threads which are threadably interengaged with interior threads associated with a fixed position nut 108, the nut nested to a location corresponding to an outer wall surface of the guide wall 22 and in order to selectively raise and lower said elongated element 100 in the manner referenced by arrow 110 (FIG. 4). The spring 104 biases the spring rod 100 downwardly while permitting vertical adjustment.

Figure 5:
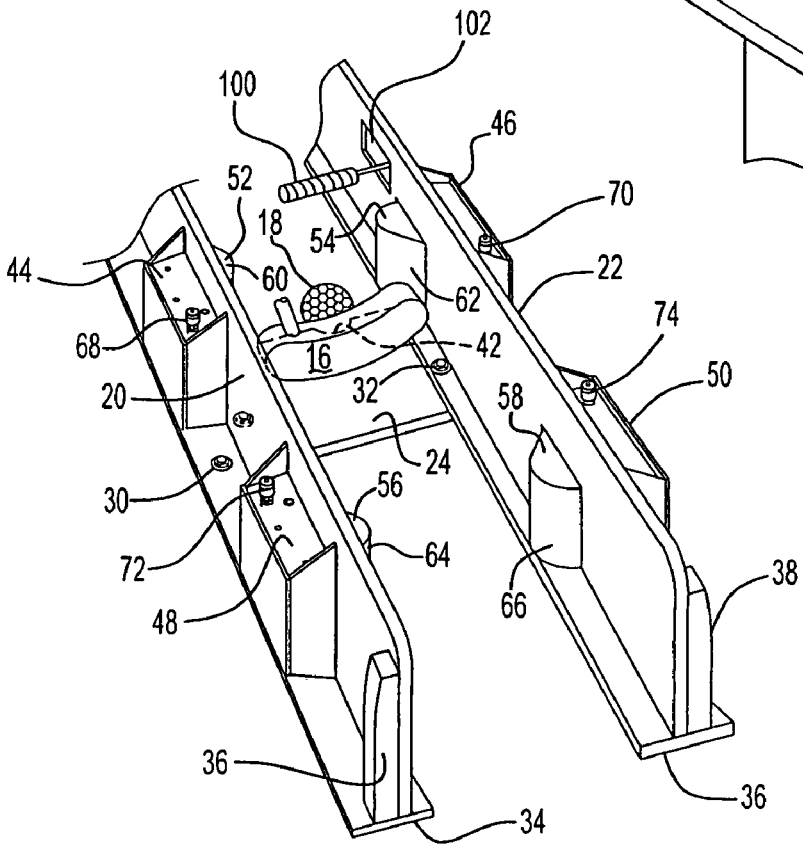
FIG. 5 is an illustration similar to that shown in FIG. 2 and showing an alternate location of the inwardly/outwardly rotatable and elongated spring element/flexible rod mounted relative to an inner facing guide wall surface according to the present invention.
Figure 6A:
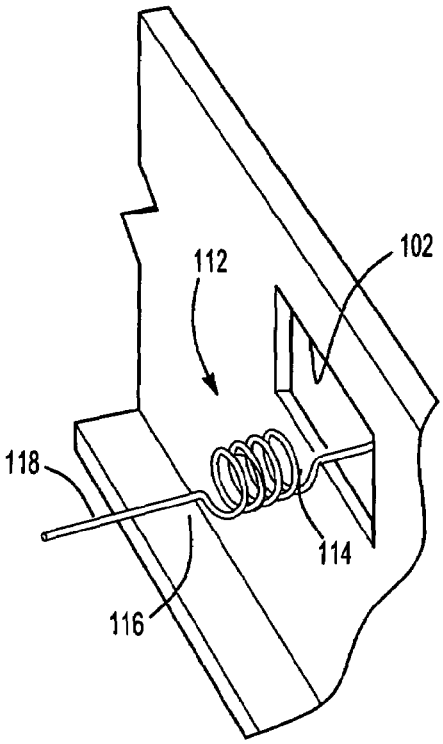
FIG. 6 is a sectional cutaway view taken along line 6—6 of FIG. 2 and illustrating the manner in which the inwardly pivoting spring element of FIG. 5 or a flexible rod of FIG. 6A is selectively raised and lowered to a desired putter head swing line adjustment position according to the present invention.
Figure 6:
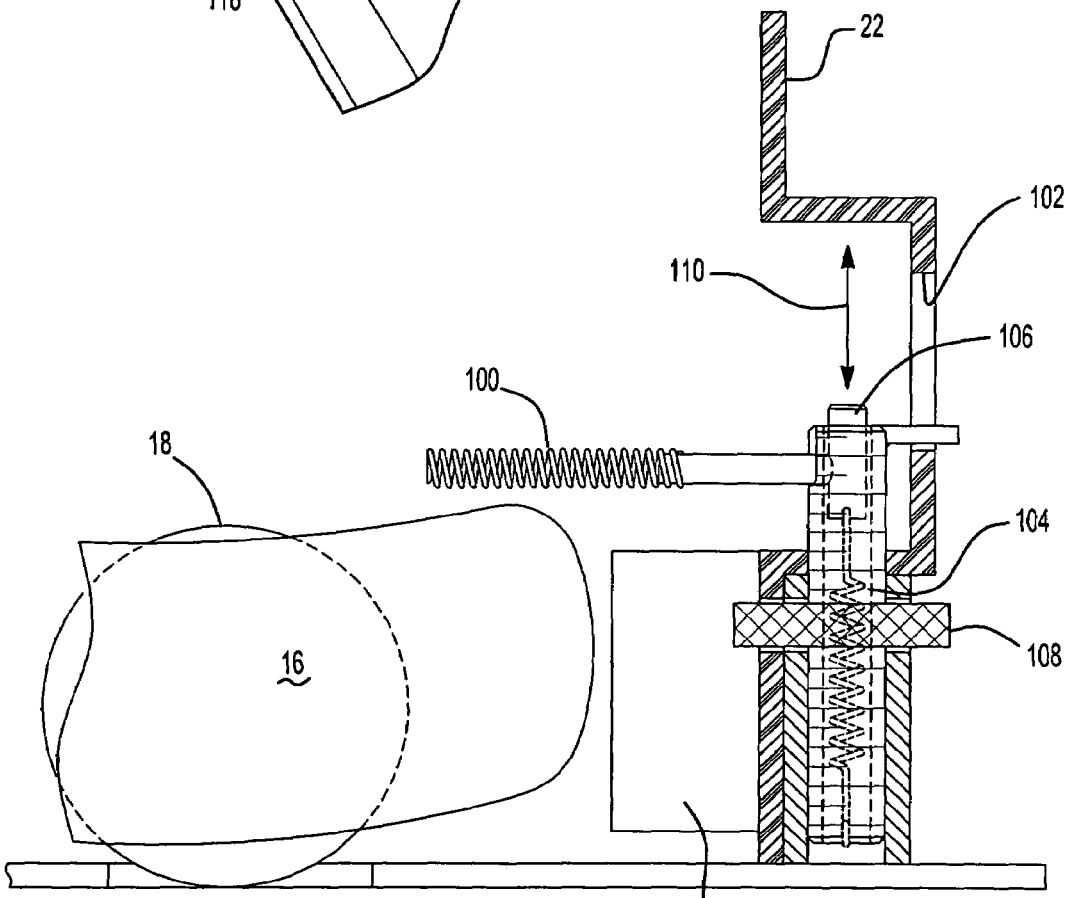

In the preferred embodiment of FIGS. 5 and 6, the rotatable and elongated element is mounted in proximity, and such as off to one side, to a specified and inwardly/outwardly adjustable cam surface. Reference is made in particular to coil spring 100 mounted in close proximity to selected forward disposed cam assembly 46.

It is typically desired that the height adjustable spring be located proximate (or above) a forwardly located cam assembly and such as to correspond to a ball striking position in which it is desired to maintain the putter head 16 to the optimum impact zone in order to avoid topping of the ball (see as further referenced by position 18' in FIG. 5). Referring to FIG. 6A, a flexible rod 112 may be substituted for the spring 100 in FIG. 6. The rod 112 includes a first stem portion 114 extending through wall aperture 102, a spring flex element 116 secured to an end of the stem portion 114, and such as which is further defined by a plurality of winding coils. and a further extending contact element 118 extending from an opposite end of the flex element 116. It is also understood that the shape and construction of the flex rod 112 may be adjusted within the scope of the invention. The use of a coil type spring/flexible rod is also desirable in that it accentuates a vibrational aspect in response to being struck by the putter head, thus indicating that the putter is outside of a correct swing arc motion.

Having described my invention, it is apparent that it teaches a novel and useful putter alignment tool and training device for assisting a user in achieving a desired and correct line of putting motion and contact surface of a golf club head relative to a ball. Additional preferred embodiments of the present device will become apparent to those skilled in the art to which it pertains and without deviating from the scope of the appended claims.

I claim:

1. A putter alignment tool for use in establishing a correct line of putting motion of a golf club head upon a golf ball, comprising:

an elongated structure including a first guide wall and a second spaced apart and substantially parallel extending guide wall, said first and second guide walls being secured together proximate at least one of first and second ends;

a golf ball placement position located between said guide walls at an intermediate location between said ends; and at least one mechanism, associated with at least one of said first and second guide walls, said mechanism including at least one arcuately shaped surface projecting inwardly through an aperture formed in at least one of said guide walls in order to adjust an interior passageway within said structure proximate said ball placement position, said arcuately shaped surfaces being outwardly depressed upon contact with a golf club head, permitting unimpeded travel of the golf club head during a putting stroke.

2. The putter alignment tool as described in claim 1, said at least one arcuately shaped surface further comprising an inwardly adjustable cam surface mounted relative to an inner facing surface of at least one of said first and second guide walls.

3. The putter alignment tool as described in claim 2, further comprising a pair of inwardly adjustable cam surfaces arranged in opposing and aligning fashion between said first and second guide walls.

4. The putter alignment tool as described in claim 3, further comprising a second pair of adjustable cam surfaces arranged an axially spaced location relative to said first pair of cam surfaces.

5. The putter alignment tool as described in claim 4, said elongated structure exhibiting a specified shape and size, said ball placement position being at an axial location between said first and second pairs of adjustable cam surfaces.

6. The putter alignment tool as described in claim 4, said elongated structure exhibiting a specified shape and size, said ball placement position being at an axial location proximate a forward pair of adjustable cam surfaces, a rearward pair of cam surfaces guiding a takeaway swing of the golf putter head.

7. The putter alignment tool as described in claim 2, said at least one mechanism further comprising a rotatable and elongated element mounted relative to an inner facing surface of at least one of said first and second guide walls.

8. The putter alignment tool as described in claim 2, said rotatable and elongated element being mounted in proximity to said inwardly adjustable cam surface.

9. The putter alignment tool as described in claim 2, said rotatable and elongated element being mounted at a location above said inwardly adjustable cam surface.

10. The putter training device according to claim 1, further comprising a crosswise extending and adjustable mechanism associated with a selected one of said first and second ends and which establishes a passageway width for allowing passage therethrough of the putter traveling along the elongated structure and between the first and second guide walls.

11. A putter alignment tool for use in establishing a correct line of putting motion of a golf club head upon a golf ball, comprising:

an elongated structure including a first guide wall and a second spaced apart and substantially parallel extending guide wall, said first and second guide walls being secured together proximate at least one of first and second ends;

a golf ball placement position located between said guide walls at an intermediate location between said ends;

a first mechanism comprising at least one inwardly adjustable cam surface projecting inwardly through an aperture formed in at least one of said first and second guide walls, said first mechanism adjusting a width an interior passageway within said structure proximate the golf club head placement position; and a second mechanism comprising a rotatable and elongated element mounted relative to an inner facing surface of at least one of said first and second guide walls, said second mechanism adjusting a height within said structure proximate the golf club head placement position;

said first and second mechanisms permitting unimpeded travel of the golf club head during a putting stroke.

12. A putter alignment tool for use in establishing a correct line of putting motion of a golf club head upon a golf ball, comprising:

an elongated structure including a first guide wall and a second spaced apart and substantially parallel extending guide wall, said first and second guide walls being secured together proximate at least one of first and second ends;

a golf ball placement position located between said guide walls at an intermediate location between said ends;

a first mechanism comprising at least one pair of inwardly adjustable cam surfaces projecting inwardly through apertures formed in said first and second guide walls, said first mechanism adjusting a width within said structure proximate the club head swing line placement position; and a second mechanism comprising a rotatable and elongated element mounted relative to an inner facing surface of at least one of said first and second guide walls and at a location proximate a selected one of said inwardly adjustable cam surfaces, said second mechanism adjusting a height within said structure proximate the golf club head placement position;

said first and second mechanisms permitting unimpeded travel of the golf club head during a putting stroke.

13. A putter alignment tool for use in establishing a correct line of putting motion of a golf club head upon a golf ball, comprising:

an elongated structure including a first guide wall and a second spaced apart and substantially parallel extending guide wall, said first and second guide walls being secured together proximate at least one of first and second ends;

a golf ball placement position located between said guide walls at an intermediate location between said ends;

at least one mechanism, associated with at least one of said first and second guide walls, said at least one mechanism further comprising an inwardly projecting and adjustable cam surface mounted relative to an inner facing surface of at least one of said first and second guide walls to adjust a width within said structure proximate said ball placement position; and said mechanism further comprising a housing secured to an outer facing surface of said at least one guide wall, a three-dimensional cam element incorporating said cam surface seating within said housing and being communicable with said structure interior through an aperture formed in said associated guide wall, said mechanism permitting unimpeded travel of the golf club head during a putting stroke.

14. The putter alignment tool as described in claim 13, further comprising an adjustment knob extending from a surface of said housing and operable to manipulate an inwardly extending position of said cam surface relative to said guide wall.

15. The putter alignment tool as described in claim 14, further comprising a stem portion associated with said cam element and securing about a pivot point extending vertically within said housing, a spring tension being associated with said stem portion, a rotatable surface associated with said adjustment knob contacting said stem portion and operable to manipulate said cam element and to reposition said projecting cam surface between a fully expanded and fully retracted position.

16. A putter alignment tool for use in establishing a correct line of putting motion of a golf club head upon a golf ball, comprising:

an elongated structure including a first guide wall and a second spaced apart and substantially parallel extending guide wall, said first and second guide walls being secured together proximate at least one of first and second ends;

a golf ball placement position located between said guide walls at an intermediate location between said ends;

a plurality of mechanisms, associated with at least one of said first and second guide walls, a first of said mechanisms comprising an inwardly projecting and adjustable cam surface mounted relative to an inner facing surface of at least one of said first and second guide walls to adjust a width within said structure proximate said ball placement position; and a second of said mechanisms comprising a rotatable and elongated element mounted relative to an inner facing surface of at least one of said first and second guide walls to adjust a height within said structure proximate said ball placement position, said elongated element further comprising at least one of a height adjustable spring and a flexible rod, said mechanisms cooperatively permitting unimpeded travel of the golf club head during a putting stroke.

17. The putter alignment tool as described in claim 16, further comprising a vertically extending shaft portion securing to a pivotal mounting end of said rotatable and elongated element, said shaft portion threadably engaging a fixed position nut element to selectively raise and lower said elongated element.

* * * * *